US007198167B2

(12) United States Patent
Marsden et al.

(10) Patent No.: US 7,198,167 B2
(45) Date of Patent: Apr. 3, 2007

(54) SIPPER CUP WITH MEDICINE DISPENSER

(75) Inventors: Andrew W. Marsden, Hingham, MA (US); Joseph C. Cacciola, Wrentham, MA (US)

(73) Assignee: Cosco Management, Inc., Wilmington, DE (US)

( * ) Notice: Subject to any disclaimer, the term of this patent is extended or adjusted under 35 U.S.C. 154(b) by 222 days.

(21) Appl. No.: 10/698,614

(22) Filed: Oct. 31, 2003

(65) Prior Publication Data

US 2005/0092754 A1 May 5, 2005

(51) Int. Cl.
*A47G 19/22* (2006.01)
*B65D 43/18* (2006.01)

(52) U.S. Cl. ..... 220/254.4; 220/212; 220/717; 220/253; 215/DIG. 7; 206/538; 73/427; 222/557

(58) Field of Classification Search ..... 220/212, 220/253, 254.4, 259.2, 259.3, 521, 522, 717; 221/96; 206/538; 73/427; 215/DIG. 7; 222/129, 130, 557
See application file for complete search history.

(56) References Cited

U.S. PATENT DOCUMENTS 1,471,793 A * 10/1923 Israel ..... 220/521
2,404,496 A * 7/1946 Henin ..... 222/456
2,469,856 A * 5/1949 Robertson ..... 220/8
2,750,066 A * 6/1956 Shekter ..... 220/521
3,302,644 A 2/1967 Kennedy et al.
3,490,290 A * 1/1970 Bilson ..... 73/427
5,079,013 A 1/1992 Belanger
5,238,140 A 8/1993 Maze
5,542,670 A 8/1996 Morano
5,611,776 A 3/1997 Simmons
5,890,620 A 4/1999 Belcastro
5,890,621 A 4/1999 Bachman et al.
6,230,923 B1 5/2001 Hung
6,321,931 B1 11/2001 Hakim et al.
6,357,620 B1 3/2002 Hakim
6,419,081 B1 7/2002 Ross
6,422,415 B1 7/2002 Manganiello
6,488,146 B1 12/2002 Dotsikas
2001/0035420 A1 11/2001 Fusco et al.
2002/0121454 A1 9/2002 Ross
2002/0158075 A1 10/2002 Caldicott et al.
2002/0179615 A1 12/2002 Hakim
2002/0185495 A1 12/2002 Managaniello

* cited by examiner

*Primary Examiner*—Anthony D. Stashick
*Assistant Examiner*—James Smalley
(74) *Attorney, Agent, or Firm*—Barnes & Thornburg LLP

(57) ABSTRACT

A cup includes a liquid storage chamber and a separate medicine storage container.

31 Claims, 3 Drawing Sheets

SIPPER CUP WITH MEDICINE DISPENSER

BACKGROUND

The present disclosure relates to cups, and particularly to sipper cups for juveniles. More particularly, the present disclosure relates to dispensers for medicines and drinking liquids.

Many patients prefer to drink water or other liquids after receiving medicine as a liquid, powder, tablet, or capsule. In many instances, the medicine is consumed in a location that does not have a source of drinking liquid readily available.

SUMMARY

A sipper cup comprises a liquid container and a closure coupled to the liquid container. A medicine container is arranged to extend into the liquid container and is accessed through a top opening formed in the closure. The closure includes a spout formed to include a passage to allow a drinking liquid to be drawn from a liquid storage chamber formed in the liquid container after a patient has consumed medicine stored in the medicine container.

In illustrative embodiments, a lid is mounted for movement on the closure to cover and uncover the top opening to control movement of medicine into and out of a medicine storage chamber formed in the medicine container. A stabilizer is coupled to the closure and arranged to help support the medicine container in an upright position on an underlying surface following removal of the closure from the liquid container.

A retainer included in the closure is configured to mate with the liquid container to close an open mouth of the liquid container and to support the medicine container in a fixed position in the liquid storage chamber. In an illustrative embodiment, the retainer is a band that surrounds an annular rim of the closure. The annular rim is formed to include the spout and to support a lip receiver. The lip receiver is located adjacent to the top opening and adapted to contact a mouth-lip area of a patient consuming medicine extant in the medicine storage chamber.

In an illustrative embodiment, the medicine container includes tiered chamber sections to facilitate volumetric measurement of medicine dispensed into the medicine container. The closure includes a top wall formed to include the top opening into the medicine storage chamber. The closure is monolithic and the top wall is integral with the "tiered" medicine container.

Features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
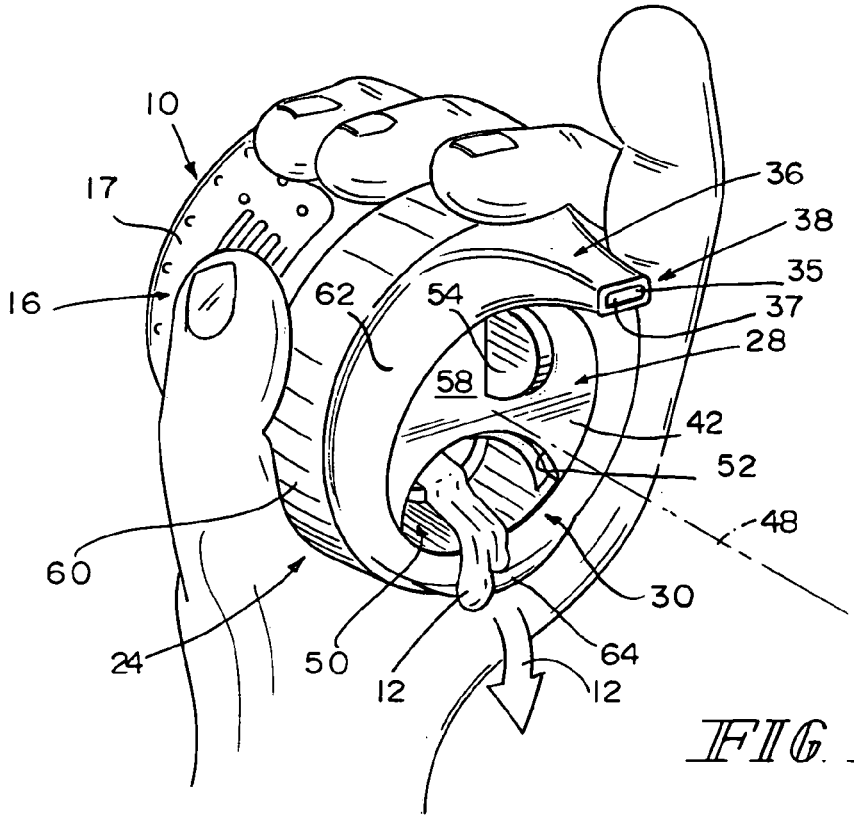
FIG. 1 is a perspective view of a sipper cup in accordance with the present disclosure showing tipping of the cup by a user to discharge a liquid medicine from a medicine storage chamber provided in the cup.
Figure 2:
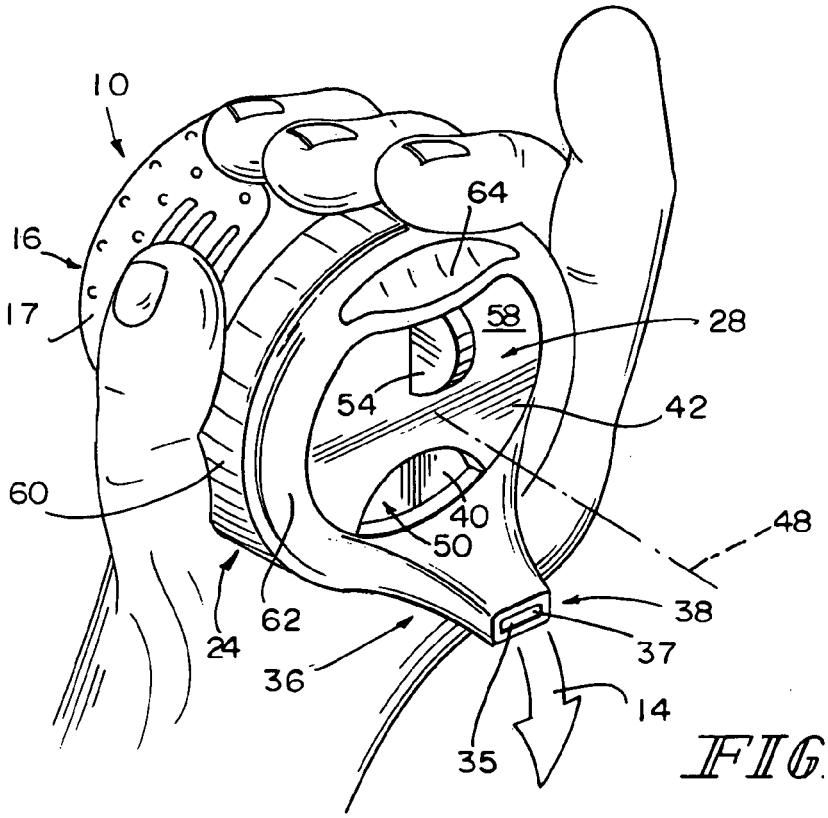
FIG. 2 is a view similar to FIG. 1 showing tipping of the cup (after rotation of the cup through a 180° angle about a central axis) by a user to discharge a drinking liquid from a spout coupled to a liquid storage chamber provided in the cup.

A sipper cup 10 can be oriented in one way to dispense a medicine 12 to a patient as suggested in FIG. 1 and then oriented in another way to dispense a drinking liquid 14 to a patient as suggested in FIG. 2. Drinking liquid 14 is stored in a liquid reservoir provided in sipper cup 10 that is separate from a medicine reservoir provided for medicine 12 to avoid intermixing of medicine 12 and drinking liquid 14 stored in cup 10. A patient may consume drinking liquid 14 using sipper cup 10 to "wash down" medicine 12 consumed earlier also using sipper cup 10. It is within the scope of this disclosure to use sipper cup 10 to dispense medicine 12 in liquid, powder, tablet, capsule, or other suitable form.

Figure 3:
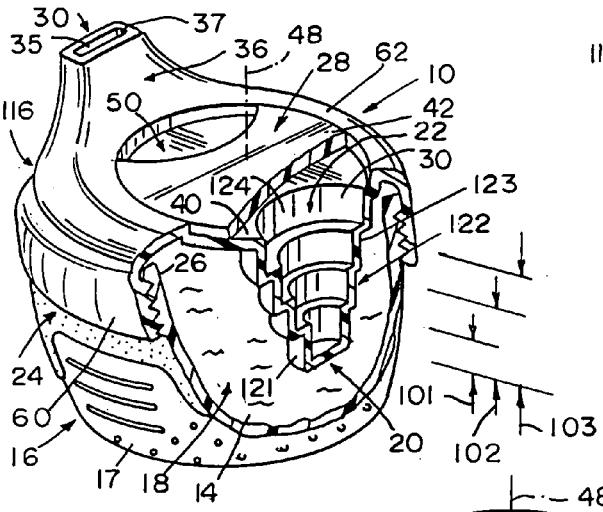
FIG. 3 is a perspective view of the sipper cup of FIGS. 1 and 2, with portions broken away, showing a medicine container suspended in a larger liquid container.
Figure 4:
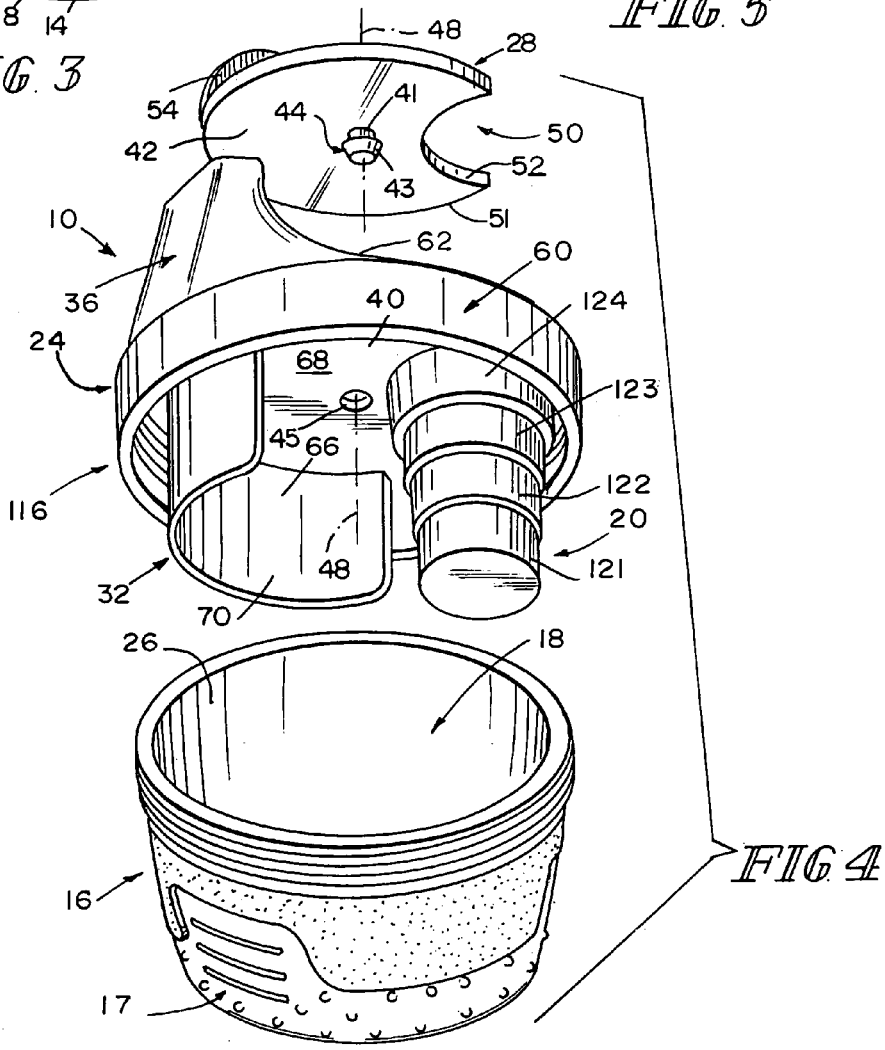
FIG. 4 is an exploded perspective view of components included in the sipper cup of FIGS. 1–3.

As shown, for example, in FIGS. 3 and 4, sipper cup 10 includes a liquid container 16 formed to include a liquid storage chamber 18 for drinking liquid 14 and a medicine container 20 formed to include a medicine storage chamber 22 for medicine 12. An over-molded grip 17 is appended to an exterior surface of liquid container 16 in the illustrated embodiment of cup 10.

Sipper cup 10 also includes a closure 24 coupled to liquid container 16 to close an open mouth 26 of liquid container 16. As suggested in FIGS. 3 and 4, medicine container 20 is coupled to an underside of closure 24 to lie in liquid storage chamber 18 when closure 24 is coupled to liquid container 16 and to move with closure 24 when closure 24 is uncoupled from liquid container 16.

Figure 5:
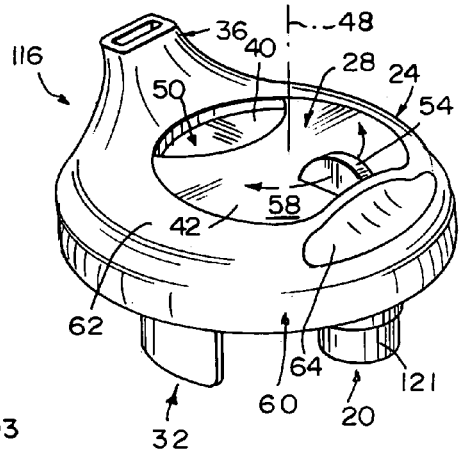
FIG. 5 is a perspective view of the closure and rotatable lid shown in FIG. 4.
Figure 6:
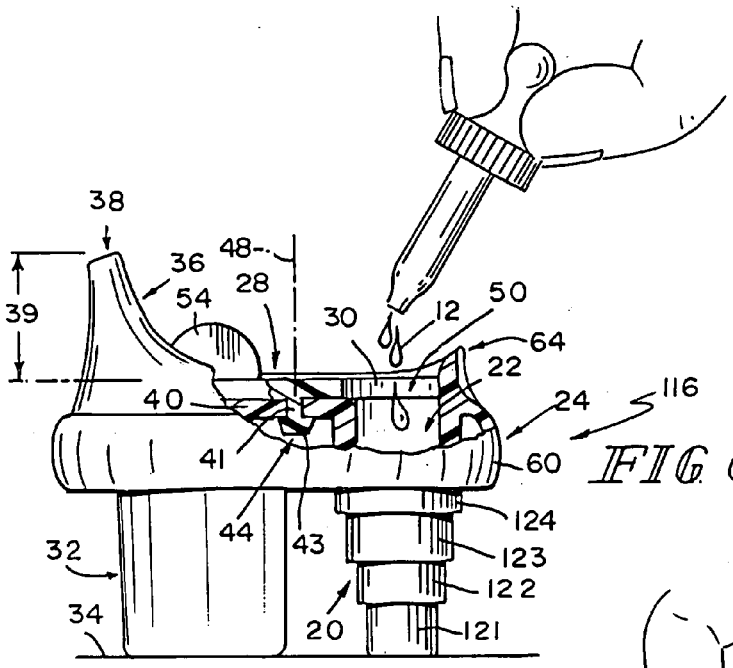
FIG. 6 is a side elevation view of the unit shown in FIG. 5, with portions broken away, showing liquid medicine being dispensed into the medicine container after movement of the lid relative to the closure to provide an opening into the medicine storage chamber formed in the medicine container.

A lid 28 is mounted for movement relative to closure 24 between an opened position shown, for example, in FIGS. 1 and 6 and a closed position shown, for example, in FIGS. 2 and 5. In the opened position, lid 28 is arranged to allow discharge of medicine 12 extant in medicine storage chamber 22 through a top opening 30 as suggested in FIG. 1. In the closed position, lid 28 is arranged to block discharge of medicine 12 extant in medicine storage chamber 22 through top opening 30.

A stabilizer 32 is coupled to closure and arranged to extend into liquid storage chamber 18 when closure 14 is coupled to liquid container 16 as suggested in FIGS. 3 and 4. Stabilizer 32 cooperates with medicine container 20 to support closure 24 in a stable (e.g., level) position upon removal of closure 24 from liquid container 16 and placement of medicine container 20 as suggested, for example, in FIG. 6. In such a stable position, a caregiver may dispense medicine 12 into medicine storage chamber 22 through top opening 30 easily.

A spout 36 is formed in closure 24 to include a passage 35 to allow drinking liquid 14 to be drawn orally by a consumer from liquid storage chamber 18 in liquid container 16 as suggested, for example, in FIGS. 2–4. Spout 36 is arranged to terminate at a tip 38 located a selected distance 39 above a top wall 40 of closure 24 as suggested in FIG. 6. Spout 36 is formed to include liquid discharge opening 37 in tip 38.

Medicine container 20 is coupled to closure 24 to extend into liquid storage chamber 18 and is arranged to allow medicine 12 to be dispensed from medicine storage chamber 22 without intermixing with drinking liquid 14 extant in liquid storage chamber 18. In the illustrated embodiment, top wall 40 of closure 24 is formed to include top opening 30 providing access into medicine storage chamber 22.

Lid 28 includes a plate 42 and a plate mount 44 coupled to an underside 46 of plate 42 as suggested, for example, in FIGS. 4 and 6. Plate mount 44 is coupled to top wall 40 to support plate 42 for movement between the opened position shown in FIG. 1 and the closed position shown in FIG. 2. In the illustrated embodiment, plate mount 44 is an axle arranged to extend through an aperture 45 formed in top wall 40 to support plate 42 for rotation relative to top wall 40 about an axis 48. In the illustrated embodiment, plate mount 44 includes cylindrical shaft 41 sized to extend through and rotate in aperture 45 and retainer plug 43 sized to limit removal of lid 28 from top wall 40 of closure 24.

Plate 42 of lid 28 is formed to include a notch 50 as shown, for example, in FIGS. 1 and 4. Notch 50 is sized and located to be aligned with top opening 30 formed in top wall 40 upon movement of lid 28 to the opened position to allow medicine 12 extant in medicine storage chamber 22 to pass through notch 50 as medicine 12 is discharged from medicine storage chamber 22. in the illustrated embodiment, plate 42 is crescent-shaped and includes a convex curved (e.g., circular) first perimeter edge 51. Plate 42 also includes a concave second perimeter edge 52 configured to define notch 50.

As suggested in FIGS. 2 and 5, plate 42 is movable relative to top wall 40 of closure 24 to cover and uncover top opening 30. A plate handle 54 is coupled to an upwardly facing surface 58 of plate 42. Plate handle 54 is arranged to extend upwardly away from top wall 40 of closure 24 to provide means for moving (e.g., rotating) plate 42 relative to top wall 40 (e.g., about axis 48) to cover and uncover top opening 30.

Tip 38 of spout 36 and top wall 40 of closure 24 cooperate to define a lid-movement region (represented by dimension 39) therebetween as suggested in FIG. 6. Lid 28 is confined to remain in this lid-movement region during movement of lid 28 between opened and closed positions.

As shown in FIGS. 3 and 4, closure 24 includes a retainer 60 configured to mate with liquid container 16 to hold medicine container 20 in a fixed position in liquid storage chamber 18. In the illustrated embodiment, retainer 60 is a band formed to include internal threads sized and shaped to engage external threads provided on liquid container 16. It is within the scope of this disclosure to configure retainer 60 in any suitable manner to couple closure 24 to liquid container 16.

An annular rim 62 is also included in closure 24 as shown in FIGS. 1–4. Annular rim 62 is interposed between top wall 40 and retainer 60. In the illustrated embodiment, annular rim 62 is formed to include a lip receiver 64 arranged to extend upwardly away from retainer 60. Annular rim 62 is placed in a location adjacent to top opening 30 into medicine storage chamber 22 and adapted to contact a mouth-lip area of a patient consuming medicine 12 extant in medicine storage chamber 22. Spout 36 is arranged to extend upwardly away from retainer 60 to locate liquid discharge opening 37 formed in spout 36 at a select distance 39 above top wall 40 to block discharge of drinking liquid 14 extant in liquid storage chamber 18 through liquid discharge opening 37 during discharge of medicine 12 extant in medicine storage chamber 22 through top opening 30 and notch 50 as suggested, for example, in FIG. 1. Spout 36 and lip receiver 64 are arranged to lie in spaced-apart, diametrically opposed relation to one another along a perimeter of top wall 40 as suggested in FIGS. 1 and 2.

It is within the scope of this disclosure to adapt lid 28 so that it can be mounted for sliding movement relative to top wall 40 and the top opening 30 formed therein to cover and uncover top opening 30. Handle 54 may be used to slide lid 28 back and forth between opened and closed positions.

Figure 8:
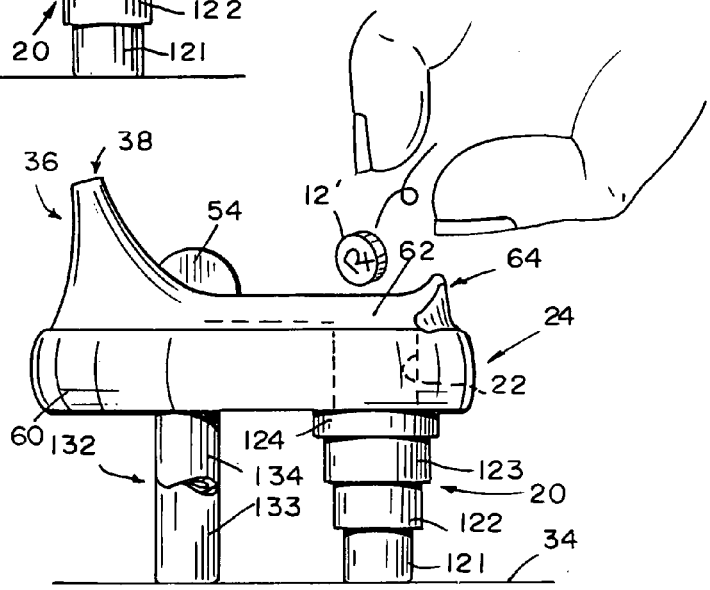
FIG. 8 is a side elevation view of the unit shown in FIG. 7.
Figure 7:
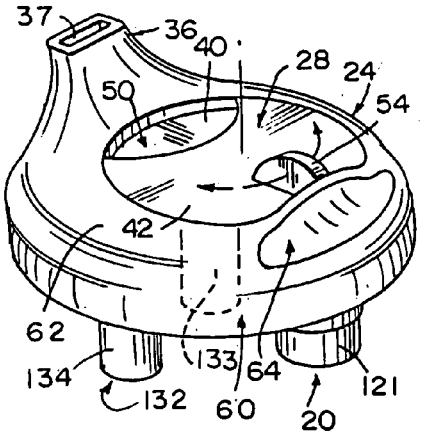
FIG. 7 is a perspective view of a closure and lid in accordance with another embodiment of the present disclosure.

As shown in FIG. 6, stabilizer 32 and medicine container 20 cooperate to provide means for supporting top wall 40 in a level position relative to underlying surface 34 upon removal of closure 24 from liquid container 16 and placement of medicine container 20 on underlying surface 34. In the embodiment illustrated in FIGS. 1–6, stabilizer 32 is a semicircular wall having a curved top edge 66 (see FIG. 4) appended to downwardly facing surface 68 of top wall 40 and having a concave surface 70 facing toward medicine container 20. The height of stabilizer 32 is equal to the height of medicine container 20 in the illustrated embodiment as suggested in FIG. 6. In the embodiment illustrated in FIGS. 7 and 8, a stabilizer 132 is provided instead of stabilizer 32. Stabilizer 132 includes a pair of vertical, spaced-apart posts 133, 134. Each post 133, 134 has a height equal to the height of medicine container 20.

Medicine container 20 is formed to include tiered chamber sections 121, 122, 123, and 124 in the illustrated embodiment as suggested in FIGS. 3–6. These sections 121, 122, 123, and 124 provide "stepped increments" to facilitate measurement (by volume) of medicine 12 extant in medicine storage chamber 22. As suggested in FIG. 3, dimension 101 represents the volume of section 121, dimension 102 represents the combined volumes of sections 121 and 122, and dimension 103 represents the combined volumes of sections 121, 122, and 123. A side wall of medicine container 20 is transparent or translucent to permit a caregiver to inspect the level of medicine 12 dispensed into tiered chamber sections 121, 122, 123, and 124 in the environment shown, for example, in FIGS. 6 and 8. The graduations provided by these tiered chamber sections facilitate volumetric measure of medicine 12 dispensed into medicine storage chamber 22.

A monolithic dispenser cover 116 is configured to be coupled to liquid container 16. Monolithic dispenser cover 116 is shown, for example, in FIGS. 3–5 and includes top wall 40, stabilizer 32, retainer 60, rim 62, spout 36, and medicine container 20. Uppermost tiered chamber section 124 of medicine container 20 merges monolithically with top wall 40 at op opening 32 as shown best in FIG. 6.

The invention claimed is:

1. A sipper cup comprising a liquid container formed to include a liquid storage chamber having an open mouth, a closure coupled to the liquid container to close the open mouth thereof, the closure including a spout formed to include a passage to allow a drinking liquid to be drawn from the liquid storage chamber, a medicine container formed to include a medicine storage chamber having a top opening, the medicine container being coupled to the closure to extend into the liquid storage chamber and arranged to allow a medicine to be dispensed from the medicine storage chamber without intermixing with drinking liquid extant in the liquid storage chamber, the closure further including a top wall formed to include the top opening of the medicine storage chamber, a lid mounted on the closure for movement below the spout and over the top wall between an opened position to allow discharge of medicine extant in the medicine storage chamber through the top opening formed in the top wall and a closed position to block discharge of medicine extant in the medicine storage chamber through the top opening formed in the top wall and further comprising a stabilizer coupled to the closure and arranged to extend into the liquid storage chamber when the closure is coupled to the liquid container and cooperate with the medicine container to provide means for supporting the top wall in a level position relative to an underlying surface upon removal of the closure from the liquid container and placement of the medicine container on the underlying surface.

2. The sipper cup of claim 1, wherein the spout is arranged to terminate at a tip located at a selected distance above the top wall and formed to include a liquid discharge opening, the tip of the spout and the top wall of the closure cooperate to define a lid-movement region therebetween, and the lid is confined to remain in the lid-movement region during movement of the lid between the opened and closed positions.

3. The sipper cup of claim 2, wherein the lid includes an axle coupled to the top wall of the closure to support the lid for rotation about an axis relative to the top wall during movement of the lid between the opened and closed positions.

4. The sipper cup of claim 2, wherein the lid includes a plate and a plate mount coupled to an underside of the plate and coupled to the top wall to support the plate for movement in the lid-movement region between the opened and closed positions.

5. The sipper cup of claim 2, wherein the lid includes a plate and a plate mount coupled to an underside of the plate and to the top wall.

6. The sipper cup of claim 5, wherein the plate mount is configured to support the plate for rotation about an axis relative to the top wall to allow the plate to rotate about the axis as the lid moves between the opened and closed positions.

7. The sipper cup of claim 5, wherein the plate is formed to include a notch and the notch is sized and located to be aligned with the top opening formed in the top wall upon movement of the lid to the opened position to allow medicine extant in the medicine storage chamber to pass through the notch as the medicine is discharged from the medicine storage chamber.

8. The sipper cup of claim 1, wherein the lid includes a plate formed to include a notch and the notch is sized and located to be aligned with the top opening formed in the top wall upon movement of the lid to the opened position to allow medicine extant in the medicine storage chamber to pass through the notch as the medicine is discharged from the medicine storage chamber.

9. The sipper cup of claim 8, wherein the plate is crescent-shaped and includes a curved first perimeter edge and a concave second perimeter edge and the concave second perimeter edge defines the notch.

10. The sipper cup of claim 1, wherein the lid includes a plate and a plate mount coupled to an underside of the plate and coupled to the top wall to support the plate for rotation about an axis and the plate is configured to cover the top opening formed in the top wall upon movement of the lid to the closed position and to uncover the top opening upon movement of the lid to the opened position.

11. The sipper cup of claim 1, wherein the lid includes a plate movable relative to the top wall to cover and uncover the top opening and a plate handle coupled to an upwardly facing surface of the plate and arranged to extend upwardly away from the top wall of the closer to provide means for moving the plate relative to the top wall of the closer to cover and uncover the top opening formed in the wall.

12. The sipper cup of claim 1, wherein the stabilizer is a semi-circular wall.

13. The sipper cup of claim 1, wherein the stabilizer includes a pair of spaced-apart posts.

14. The sipper cup of claim 1, wherein the closure further includes a retainer band configured to mate with the liquid container to hold the medicine container in a fixed position in the liquid storage chamber and an annular rim interposed between the top wall and the retainer band and the annular rim is formed to include a lip receiver arranged to extend upwardly away from the retainer band in a location adjacent to the top opening of the medicine storage chamber and adapted to contact a mouth-lip area of a patient consuming medicine extant in the medicine storage chamber.

15. The sipper cup of claim 14, wherein the annular rim is formed to include the spout and the spout is arranged to extend upwardly away from the retainer to locate a liquid discharge opening formed in the spout at a selected distance above the top wall to block discharge of drinking liquid extant in the liquid storage chamber through the liquid discharge opening during discharge of medicine extant in the medicine storage chamber through the top opening formed in the top wall.

16. The sipper cup of claim 14, wherein the spout and lip receiver are arranged to lie in spaced-apart, diametrically opposed relation to one another along a perimeter of the top wall.

17. A sipper cup comprising a liquid container formed to include a liquid storage chamber having an open mouth, a closure coupled to the liquid container to close the open mouth thereof, the closure including a spout formed to include a passage to allow a drinking liquid to be drawn from the liquid storage chamber, the closure being formed to include a top opening, a medicine container formed to include a medicine storage chamber and arranged to lie in the liquid storage chamber to allow medicine to be admitted into the medicine storage chamber through the top opening formed in the closure, a lid mounted for rotation relative to the closure about an axis between an opened position to allow discharge of medicine extant in the medicine storage chamber through the top opening and a closed position to block discharge of medicine extant in the medicine storage chamber through the top opening, wherein the closure includes a top wall formed to include the top opening and arranged to underlie a plate of the lid and to support the medicine container in the liquid storage chamber, an annular rim arranged to extend around the top wall and formed to include the spout, and a retainer arranged to depend from the annular rim and configured to mate with the liquid container to hold the medicine container in a fixed position in the liquid storage chamber, and wherein the annular rim is formed to include a lip receiver arranged to extend upwardly away from the retainer in a location adjacent to the top opening and adapted to contact a mouth-lip area of a patient consuming medicine extant in the medicine storage chamber.

18. The sipper cup of claim 17, wherein the lid includes an axle coupled to the closure to support the lid for rotation about the axis.

19. The sipper cup of claim 18, wherein the plate is coupled to the axle to rotate therewith and is formed to include a notch sized to be aligned with the top opening upon rotation of the lid to the opened position to allow medicine extant in the medicine storage chamber to pass through the notch as the medicine is discharged from the medicine storage chamber.

20. The sipper cup of claim 19, wherein the plate is crescent-shaped and includes a curved first perimeter edge and a concave second perimeter edge and the concave second perimeter edge defines the notch.

21. The sipper cup of claim 19, wherein the lid further includes a plate handle coupled to the plate to provide means for rotating the plate about the axis relative to the closure to cover and uncover the top opening formed in the closure.

22. The sipper cup of claim 17, wherein the lid includes a plate arranged to overlie the top opening of the closure and a plate handle coupled to the plate to provide means for rotating the plate about the axis relative to the closure to cover and uncover the top opening formed in the closure.

23. The sipper cup of claim 22, wherein the plate is formed to include a notch sized to be aligned with the top opening upon rotation of the lid to the opened position to allow medicine extant in the medicine storage chamber to pass through the notch as the medicine is discharged from the medicine storage chamber.

24. A sipper cup comprising a liquid container formed to include a liquid storage chamber having an open mouth, a closure coupled to the liquid container to close the open mouth thereof, the closure including a spout formed to include a passage to allow a drinking liquid to be drawn from the liquid storage chamber, the closure being formed to include a top opening, a medicine container formed to include a medicine storage chamber and arranged to lie in the liquid storage chamber to allow medicine to be admitted into the medicine storage chamber through the top opening formed in the closure, a lid mounted for rotation relative to the closure about an axis between an opened position to allow discharge of medicine extant in the medicine storage chamber through the top opening and a closed position to block discharge of medicine extant in the medicine storage chamber through the top opening, further comprising a stabilizer coupled to the closure and arranged to extend into the liquid storage chamber when the closure is coupled to the liquid container, and wherein the stabilizer includes a pair of spaced-apart posts.

25. A sipper cup comprising a liquid container formed to include a liquid storage chamber having an open mouth, a closure coupled to the liquid container to close the open mouth thereof, the closure including a spout formed to include a passage to allow a drinking liquid to be drawn from the liquid storage chamber, the closure being formed to include a top opening, a medicine container formed to include a medicine storage chamber and arranged to lie in the liquid storage chamber to allow medicine to be admitted into the medicine storage chamber through the top opening formed in the closure, and a stabilizer coupled to the closure and arranged to extend into the liquid storage chamber when the closure is coupled to the liquid container and to cooperate with the medicine container to support the closure in a level position upon removal of the closure from the liquid container and placement of the medicine container on a surface underlying the closure.

26. The sipper cup of claim 25, wherein the stabilizer is arranged to lie in spaced-apart relation to the medicine container.

27. The sipper cup of claim 25, wherein the closure includes a top wall formed to include the top opening and the stabilizer is coupled to an underside of the top wall.

28. The sipper cup of claim 27, wherein the stabilizer is arranged to lie in spaced-apart relation to the medicine container.

29. The sipper cup of claim 25, wherein the stabilizer is a semicircular wall.

30. The sipper cup of claim 25, wherein the stabilizer includes a pair of spaced-apart posts.

31. The sipper cup of claim 25, wherein the stabilizer includes an upright post.

* * * * *